US008350777B2

(12) United States Patent
Morton et al.

(10) Patent No.: US 8,350,777 B2
(45) Date of Patent: Jan. 8, 2013

(54) METAMATERIAL RADOME/ISOLATOR

(75) Inventors: Matthew A. Morton, Reading, MA (US); Payam Shoghi, Cambridge, MA (US); Mary K. Herndon, Littleton, MA (US)

(73) Assignee: Raytheon Company, Waltham, MA (US)

( * ) Notice: Subject to any disclaimer, the term of this patent is extended or adjusted under 35 U.S.C. 154(b) by 417 days.

(21) Appl. No.: 12/658,979

(22) Filed: Feb. 18, 2010

(65) Prior Publication Data

US 2011/0199281 A1 Aug. 18, 2011

(51) Int. Cl.
*H01Q 1/42* (2006.01)

(52) U.S. Cl. ..... 343/872

(58) Field of Classification Search ..... 343/873, 343/872, 702, 909

See application file for complete search history.

(56) References Cited

U.S. PATENT DOCUMENTS

| | | | | |
|---|---|---|---|---|
| 6,639,567 | B2 | 10/2003 | Chang et al. | |
| 6,975,279 | B2 | 12/2005 | Delgado et al. | |
| 7,397,055 | B2 | 7/2008 | Barker et al. | |
| 7,525,506 | B2 | 4/2009 | Wu et al. | |
| 7,560,400 | B2 | 7/2009 | Fredberg et al. | |
| 2004/0227687 | A1 * | 11/2004 | Delgado et al. | 343/872 |
| 2005/0078048 | A1 * | 4/2005 | Delgado et al. | 343/872 |
| 2009/0135086 | A1 * | 5/2009 | Fuller et al. | 343/909 |
| 2010/0109966 | A1 * | 5/2010 | Mateychuk et al. | 343/841 |
| 2010/0232017 | A1 * | 9/2010 | McCarthy et al. | 359/486 |
| 2010/0283705 | A1 * | 11/2010 | Achour et al. | 343/844 |
| 2010/0301971 | A1 * | 12/2010 | Yonak et al. | 333/219.1 |
| 2011/0260946 | A1 * | 10/2011 | Dandekar et al. | 343/893 |
| 2011/0317275 | A1 * | 12/2011 | Smith et al. | 359/652 |

OTHER PUBLICATIONS

Cory et al., "Use of conjugate dielectric and metamaterial slabs as radomes", Special Issue of Metamaterials LHM, IET Microwaves, Antennas & Propagation, Feb. 2007, 1, (1), pp. 137-143.

Wu et al., Planar High Gain Antenna for 5.8-GHz WiMAX Operation, TENCON 2007, IEEE Region 10 Conference, IEEE, Oct. 30-Nov. 2, 2007, 3 pages (unnumbered).

Wu et al., "Novel High Gain Metamaterial Antenna Radome for WiMAX Operation in the 5.8-GHz band", Antennas and Propagation Society International Symposium, 2007, IEEE, Jun. 9-15, 2007, pp. 3488-3491.

U.S. Appl. No. 12/286,332, filed Sep. 30, 2008, Morton et al.

U.S. Appl. No. 11/906,729, filed Oct. 3, 2007, Chang et al.

* cited by examiner

*Primary Examiner* — Huedung Mancuso

(74) *Attorney, Agent, or Firm* — Cantor Colburn LLP

(57) ABSTRACT

A metamaterial radome/isolator system includes a radiation source for providing a radiation beam through the radome/isolator having a frequency beyond the bandgap region where the metamaterial permittivity and permeability are both positive and the metamaterial medium has a low, matched relative permittivity and relative permeability.

12 Claims, 9 Drawing Sheets

METAMATERIAL RADOME/ISOLATOR

FIELD OF THE INVENTION

This invention relates to a metamaterial radome or isolator.

BACKGROUND OF THE INVENTION

The current state of the art in radome design features low loss tangent, low $\in_r$ metamaterials such as Teflon or microwave laminates. Because the dielectric materials comprising the radome have positive permittivity greater than one (typically, greater than 2.1), the radome reduces the transmitted power by reflecting energy at the material interface, and refracts incident waves ultimately corrupting the beam shape.

Existing metamaterial solutions have demonstrated the ability to correct refraction in radomes in a variety of ways, but all such techniques are inherently narrowband (<1%) and have little impact on the reflection at the radome interface caused by characteristic impedance mismatch.

SUMMARY OF THE INVENTION

In accordance with various aspects of the subject invention in at least one embodiment the invention presents an improved metamaterial radome or isolator which provides lower reflection, less acute diffraction and operates in a more stable frequency range.

In one embodiment a metamaterial radome/isolator system includes a metamaterial medium having a low matched relative permittivity $\in_r$ and relative permeability $\mu_r$ where a radiation source provides a radiation beam through the metamaterial medium having a frequency beyond the bandgap region where the permittivity and permeability are both positive.

In preferred embodiments the metamaterial may be a multilayer structure. The metamaterial may be made from one of a group including: Rogers Materials, laminates, liquid crystal polymers (LCP's) and Teflon. The relative permittivity and permeability may be in the range of 0.5-10.0. The metamaterial may have an index of refraction (n) in the range of 0.5-10. The radiation source may include a phased array. The metamaterial medium may include a plurality of unit cells arranged in a periodic array. Each circuit cell may include a plurality of dielectric layers with a metal structure thereon. The metal structure may be an open turn.

In another embodiment a metamaterial radome/isolator includes a radiation source for providing a radiation beam through the radome/isolator having a frequency beyond the bandgap region where the metamaterial permittivity and permeability are both positive and the metamaterial medium has a low, matched relative permittivity and relative permeability.

In preferred embodiments the metamaterial may be a multilayer structure. The metamaterial may be made from one of a group including: Rogers Materials, laminates, liquid crystal polymers (LCP's) and Teflon. The relative permittivity and permeability may be in the range of 0.5-10.0. The metamaterial may have an index of refraction (n) in the range of 0.5-10. The radiation source may include a phased array. The metamaterial medium may include a plurality of unit cells arranged in a periodic array. Each circuit cell may include a plurality of dielectric layers with a metal structure thereon. The metal structure may be an open turn.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
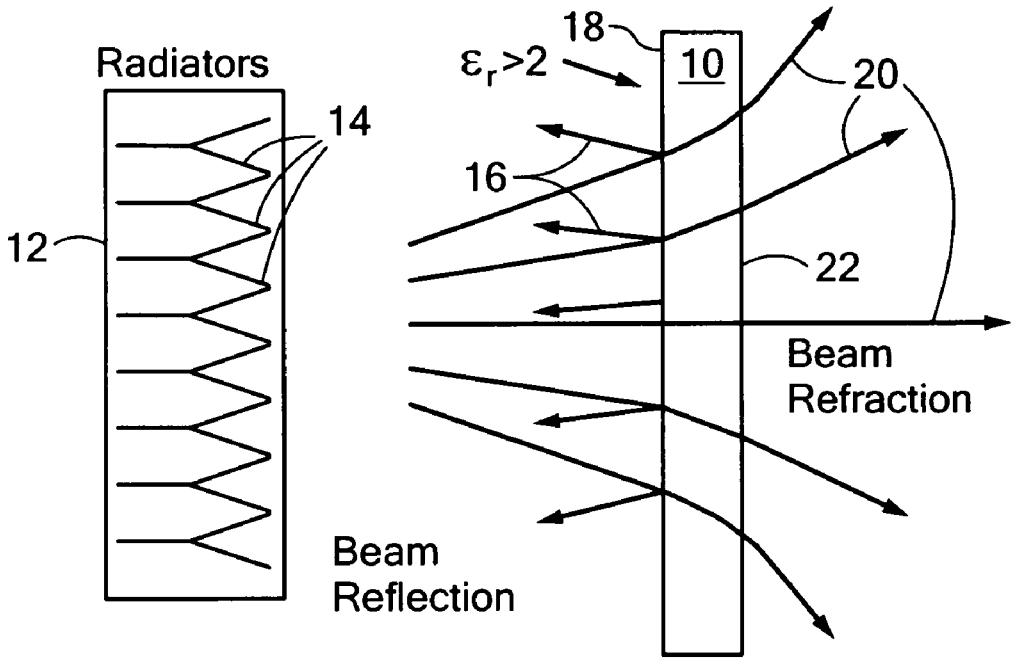
FIG. 1 PRIOR ART
FIG. 1 is a ray diagram illustrating beam reflection and refraction in a prior art radome or isolator.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

The purpose of a radome is to provide mechanical protection of the radiating elements and any related sub-system components from the external operational environment, to include humidity, particulates, chemical contaminates, oxidation, temperature variations, and ambient radiation.

Because the dielectric materials comprising a radome or isolator have positive permittivity greater than one (typically, greater than 2.1), two negative effects unrelated to loss tangent are caused by the mismatch between the characteristic impedance and refractive index of the radome material and that of free space. This characteristic impedance and refractive index may be defined as:

$$Z_0 = \sqrt{\frac{\mu_r \mu_0}{\varepsilon_r \varepsilon_0}} \qquad \eta = \sqrt{\varepsilon_r \cdot \mu_r}$$

allowing the calculation of $Z_0$ and $\eta$ for free space and the lowest-available $\in_r$ material (Teflon) as:

$$Z_{0,air} = \sqrt{\frac{\mu_r \mu_0}{\varepsilon_r \varepsilon_0}} = \sqrt{\frac{1 \cdot 1.257 \cdot 10^{-6}}{1 \cdot 8.854 \cdot 10^{-12}}} \approx 377\Omega$$

$$\eta_{air} = \sqrt{\varepsilon_r \cdot \mu_r} = \sqrt{1 \cdot 1} = 1$$

$$Z_{0,teflon} = \sqrt{\frac{\mu_r \mu_0}{\varepsilon_r \varepsilon_0}} = \sqrt{\frac{1 \cdot 1.257 \cdot 10^{-6}}{2.1 \cdot 8.854 \cdot 10^{-12}}} \approx 260\Omega$$

$$\eta_{teflon} = \sqrt{\varepsilon_r \cdot \mu_r} = \sqrt{2.1 \cdot 1} = 1.45$$

For an electromagnetic wave propagating from free space into the radome material, the difference in characteristic impedance between free space and the radome material causes reflections of electromagnetic waves off of the surface of the dielectric material. This reflection also occurs as the wave propagates from the dielectric material back into free space on the other side of the radome. Both of these reflections contribute to loss in transmitted signal power and decreased sensitivity in radar applications, as the reflected power (even in this best-available dielectric case) is sufficiently high to interfere with reflections off of close-in targets and potentially strong enough to damage electrical components in the receive or transmit paths.

For incident waves that approach the material boundaries at off-normal incidences, the difference in refractive index causes the direction of propagation to refract further away from normal incidence. This reduces beam directivity, and complicates calibration of the directed beam angle to the intended beam angle. Variations in the radome material can further complicate matters, by providing non-uniform incidence angles across the dielectric surface because of surface non-planarity and radome misalignment.

There is shown in FIG. 1 a conventional prior art radome or isolator 10 with radiation source 12 including a phased array of radiators 14. As demonstrated in FIG. 1 the beam suffers a loss of power by the reflection 16 of the beam off the surface 18 of radome or isolator 10 and the beam is also refracted 20 as it leaves the front surface 22 of radome or isolator 10.

Figure 2:
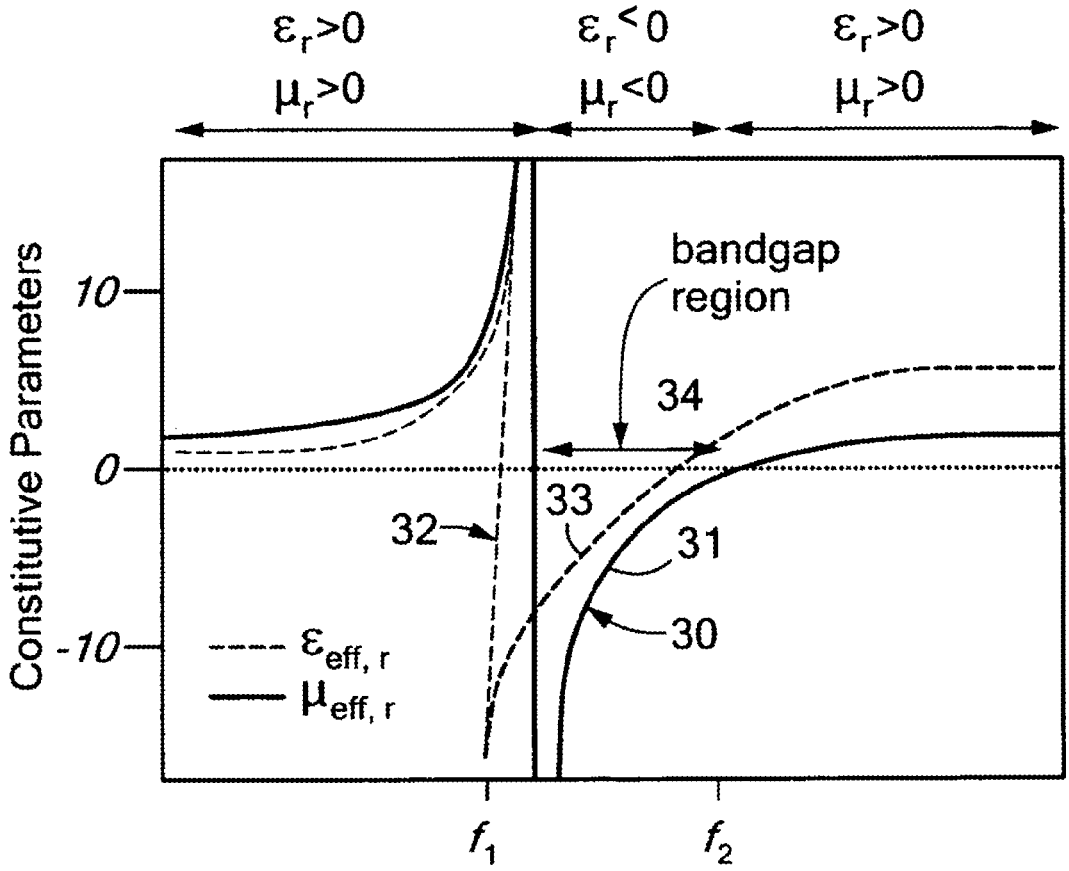
FIG. 2 PRIOR ART
FIG. 2 is an illustration of the characteristic constitutive parameters of a prior art metamaterial radome or isolator having both negative relative permittivity $\in_r$ and negative relative permeability $\mu_r$ defining the bandgap region.

In one prior art approach to this problem the radome is made up of metamaterial which has a negative permittivity $\in_r$ and a negative permeability $\mu_r$ which ranges between frequencies $f_1$ and $f_2$ which define the conventional bandgap region. The bandgap region is defined as the region where one or both of the constitutive parameters, permittivity and permeability, are negative. Metamaterials are artificial materials engineered to provide properties which may not be readily available in nature. They usually gain their properties from structure rather than composition using the inclusion of small inhomogeneities to enable effective macroscopic behavior. They include such materials as Rogers Materials, e.g. #3003 with copper cladding, laminates, e.g. TLG 29 offered by Taconic, liquid crystal polymers (LCP's) and Teflon. The characteristics of the constitutive parameters in such devices are shown in FIG. 2 where the permeability characteristic 30 and the permittivity characteristic 32 closely follow each other and are negative in the defined bandgap region 34 in the range between frequencies $f_1$ and $f_2$. One shortcoming of this approach is that the beam frequency is operating on a very steep slope 31, 33 of both characteristics 30 and 32 so that even very slight changes, in frequency, in the kilocycle range, will change the constitutive parameters and cause unwanted variations in the beam.

Figure 3:
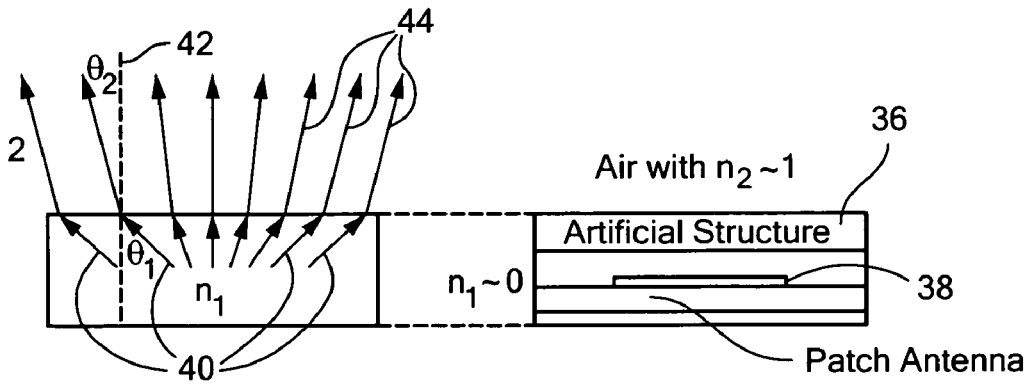
FIG. 3 PRIOR ART
FIG. 3 is a diagram showing the metamaterial of FIG. 2 and its effect on the refraction of the radiation beam.
Figure 4:
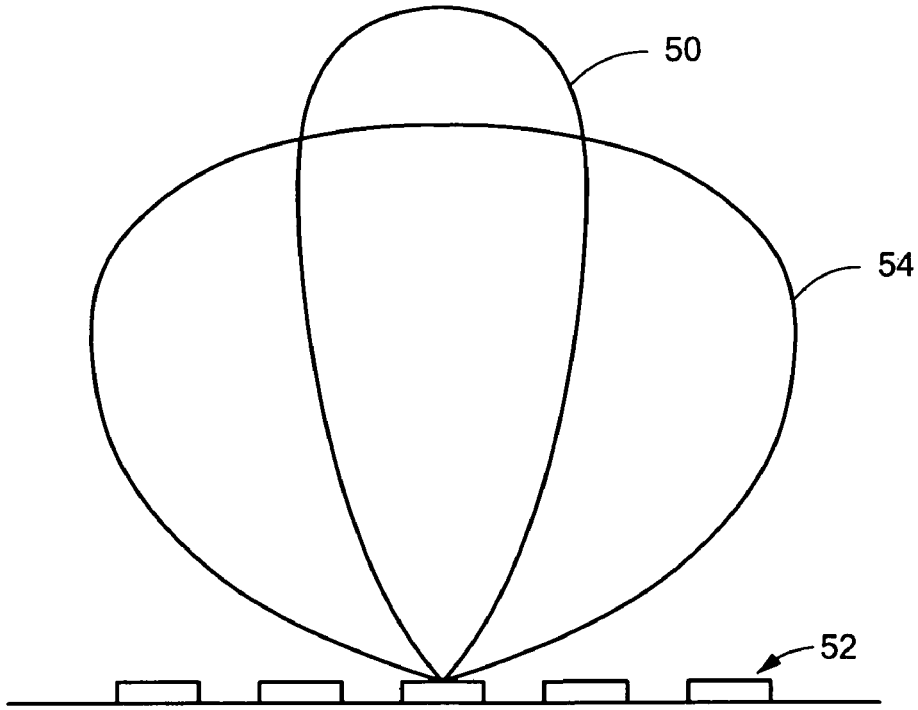
FIG. 4 PRIOR ART
FIG. 4 is a diagram showing the increased directivity caused by the metamaterial of FIGS. 2 and 3.
Figure 5:
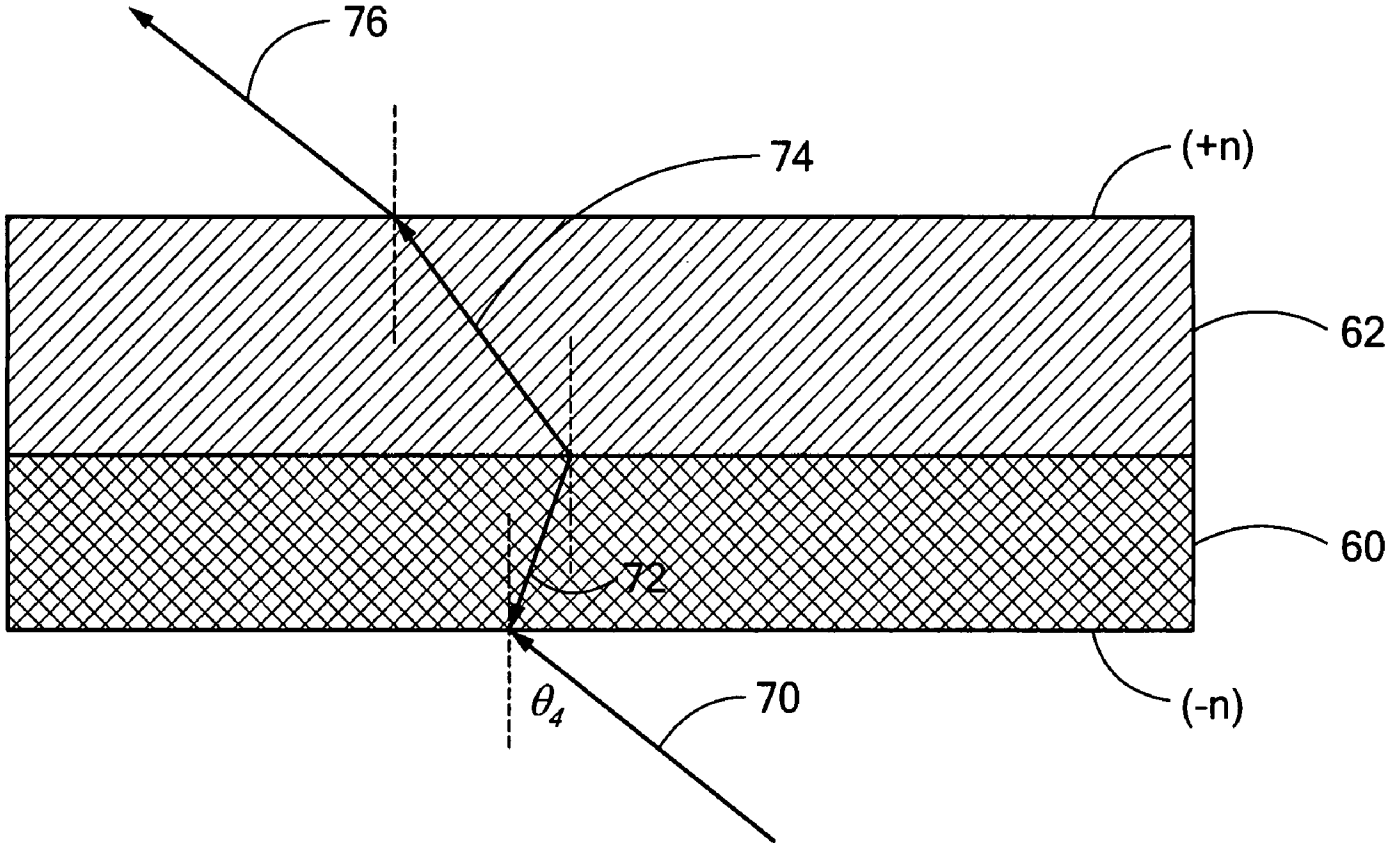
FIG. 5 PRIOR ART
FIG. 5 is a ray diagram of another prior art approach in which a negative index of refraction (−n) metamaterial is paired with a matched positive index of refraction (+n) material to mediate the directivity caused by the negative index of refraction metamaterial.

A metamaterial 36 which embodies those characteristics is shown in FIG. 3 along with a patch antenna 38, a portion of which includes schematically a ray diagram, where it is shown that metamaterial 36 with a negative index of refraction −n refracts the incident waves 40 towards the normal 42 so that the exiting rays 44 tend toward more directionality. As can be seen in FIG. 4, this causes antenna radiation to have greater directivity as shown at 50, which can be undesirable, especially where a phased array such as phased array 52 is being used: a less directed radiation pattern 54 is desirable. A further prior art approach to correct that directivity uses a negative index of refraction −n metamaterial 60, FIG. 5, but in combination with a positive material 62 (that need not be a metamaterial) which has a matched but positive index of refraction n. In this way the incoming ray 70 is refracted as at 72 but then is refracted an equal and opposite amount in layer 62 which has a positive index of refraction 74 so that the exiting ray 76 is generally parallel and in the same direction as the original ray 70.

In accordance with one embodiment of the invention a metamaterial for the radome or isolator has low, matched relative permittivity and relative permeability and the radiation source provides a radiation beam through the metamaterial medium having a frequency beyond the bandgap region where the permittivity and permeability are both positive.

Such a metamaterial presents an interface with permittivity ($\in_r$) and permeability ($\mu_r$) such that $$\varepsilon_r \approx \mu_r, \text{ leading to } \sqrt{\frac{\mu_r \mu_0}{\varepsilon_r \varepsilon_0}} = \sqrt{\frac{\mu_0}{\varepsilon_0}} \approx 377\Omega \approx Z_{0,air}$$

and $$|\varepsilon_r|, |\mu_r| < 2, \text{ leading to } \sqrt{\varepsilon_r \cdot \mu_r} \approx \sqrt{1.2 \cdot 1.2} = 1.2 < \eta_{teflron}$$

Figure 6:
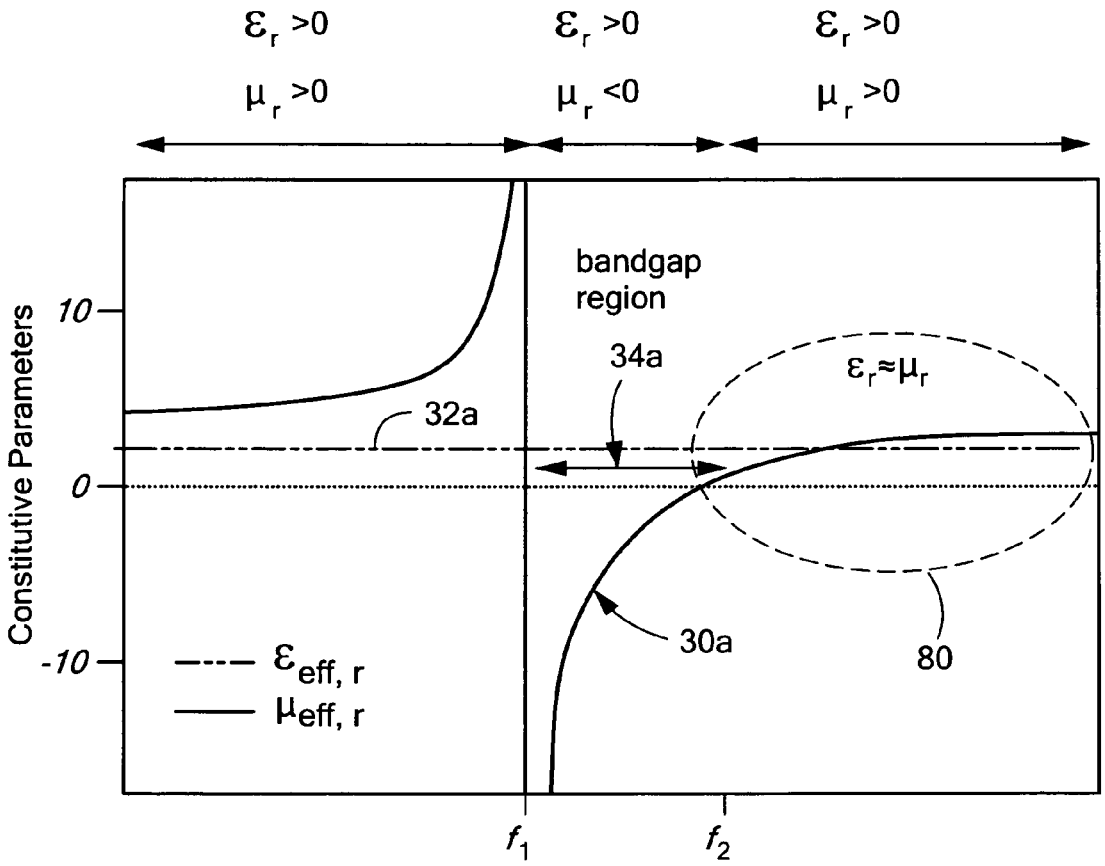
FIG. 6 is an illustration of the characteristic constitutive parameters in accordance with one embodiment of the invention where the operating region is beyond the bandgap region and where the permittivity and permeability are positive, matched and low.

The constitutive parameters for such a material are shown in FIG. 6, where permeability $\mu_r$, 30*a*, and permittivity $\in_r$, 32*a*, are employed beyond the bandgap region 34*a* in a region 80 where the constitutive parameters $\in_r$ and $\mu_r$ are matched, are equal or approximately equal, and are both positive and are low in value. Operating in this region minimizes reflections as well as minimizes refraction and in addition this region is a portion of the characteristics where, unlike the bandgap region, small changes in frequency will not cause substantial changes in the constituted parameters. Typically the constitutive parameters, both relative permittivity $\in_r$ and relative permeability $\mu_r$ are in the range of 0.5-10 and the index of refraction is in the range of 0.5-10.

Figure 7:
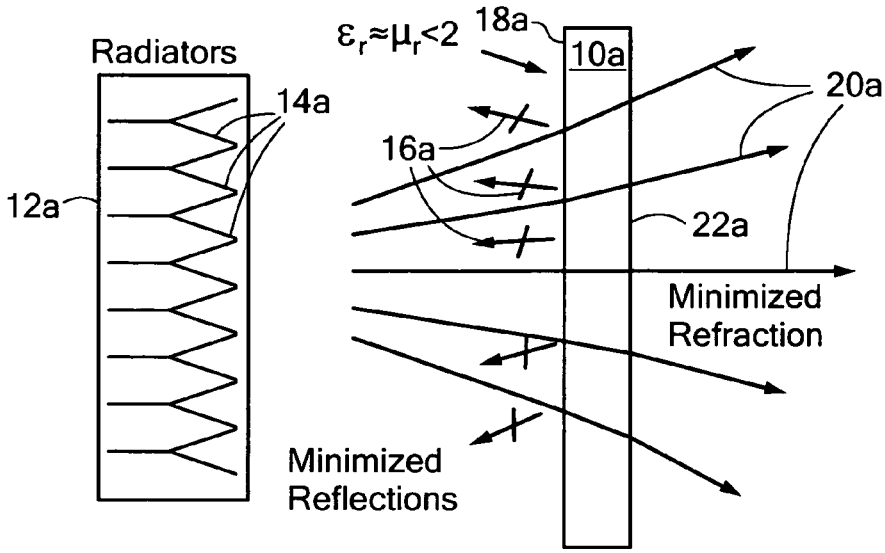
FIG. 7 is a ray diagram illustrating beam reflection and refraction in a radome or isolator in accordance with one embodiment of the invention.

The result as shown in FIG. 7 is that the radome or isolator 10*a*, FIG. 7, responds to the beam emitted by the radiators 14*a* of the phased array 12*a* with reduced reflections 16*a* and reduced refraction 20*a*.

Figure 8:
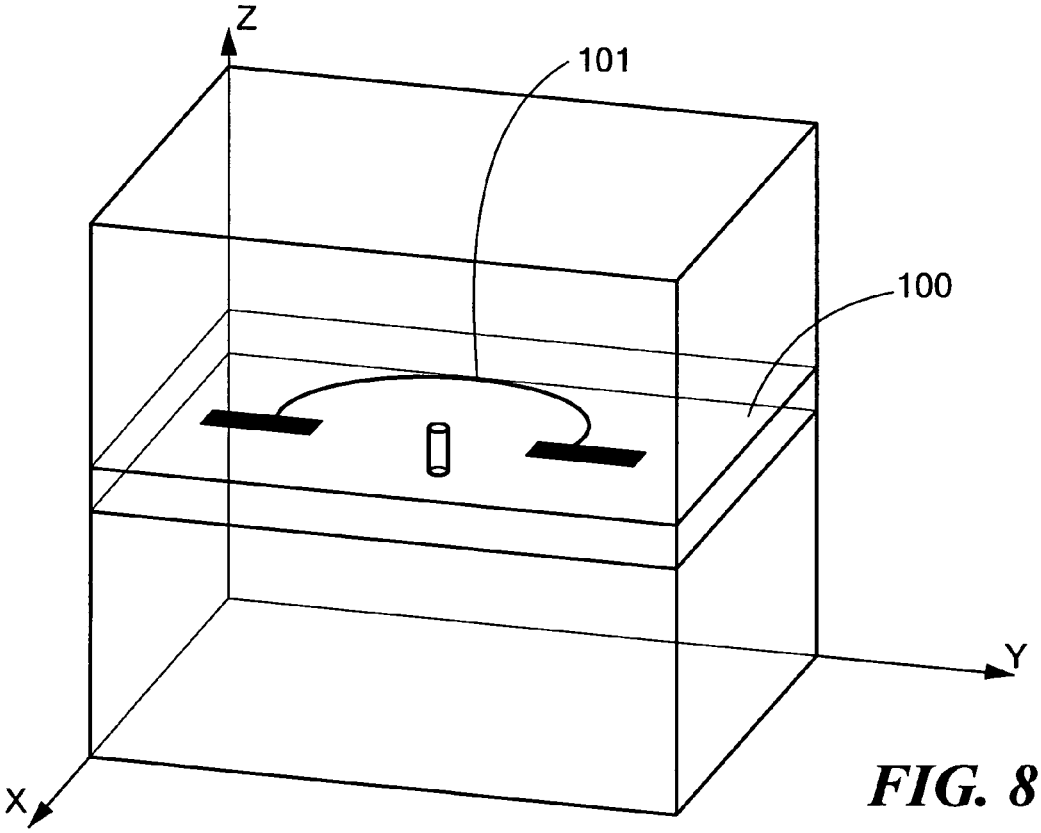
FIG. 8 is a three dimensional view of a single cell layer of a conventional metamaterial.
Figure 9:
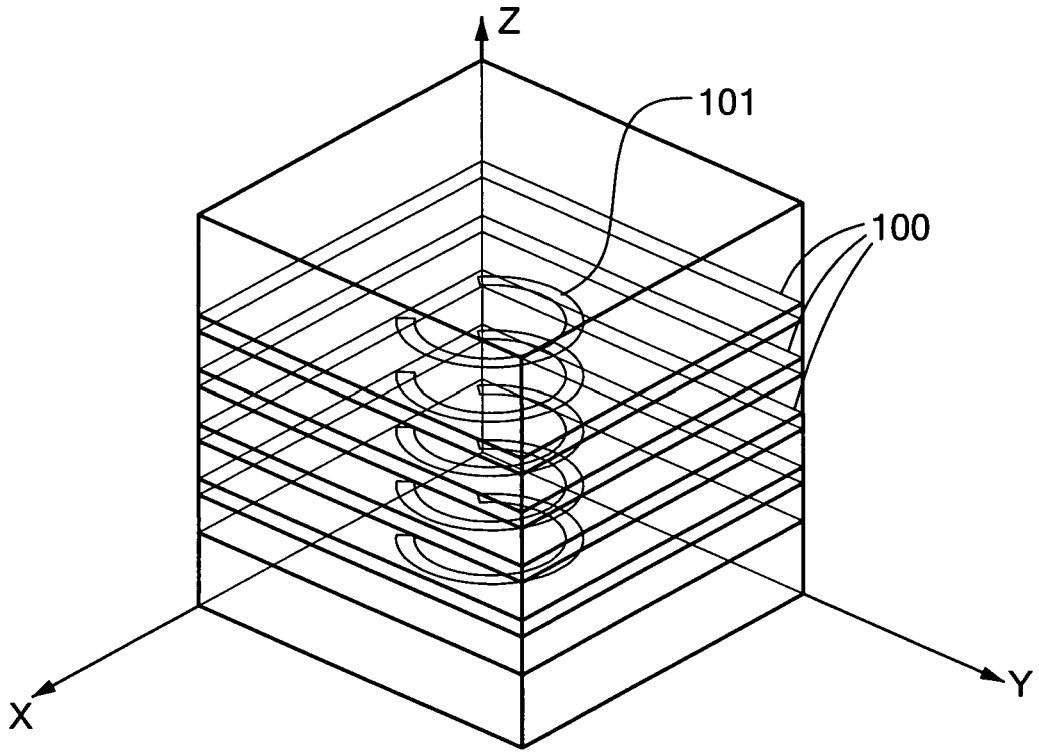
FIG. 9 is a three dimensional view of a multi-cell layer of a conventional metamaterial.
Figure 10:
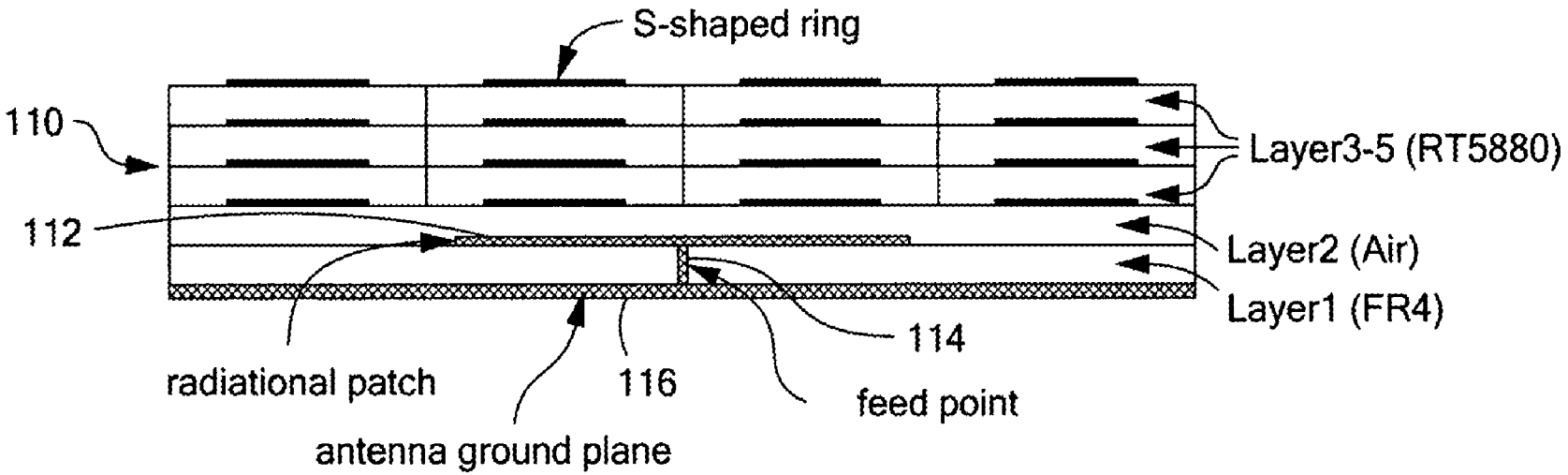
PRIOR ART FIG. 10
FIG. 10 is a schematic side sectional elevational view of a multi-cell metamaterial radome or isolator associated with a radiation patch antenna.

Metamaterials are well known and are typically formed of individual cells 100, FIG. 8, periodically replicated widely in the x and y planes and may be stacked in the z plane as shown in FIG. 9. The metamaterial radome structure is designed by modeling the behavior of the macroscopic effects by the use of electromagnetic symmetry planes around a defined unit cell. This unit cell is created with one or more dielectric layers, with one or more patterned metal layers similarly to that shown in FIG. 10.

To construct a metamaterial unit cell a configuration is used that presents a negative permittivity and permeability of negative values. The configuration described by this invention uses a similar technique, but enforces the configuration to present the bandgap behavior lower in frequency than the desired operational frequency band. The unit cell is then configured to have low and equal value permittivity and permeability in the higher frequency bands that have less value-dependency on frequency. The permittivity can be independently designed by using a metal configuration e.g. including the open turn 101 that interacts with the electric field, such as the vertical via through the substrate in FIG. 8. The permeability can be independently designed by using a resonant loop structure such as the omega configuration in FIG. 8. The via and omega cell depicted in FIG. 8 provides the necessary control of both the permittivity and permeability, but is not the only possible metal configuration to provide control of both constitutive parameters. Using this method, a periodic structure providing the electrical properties defined by the invention are provided.

To create a metamaterial radome structure that exhibits the electrical properties described by the invention and the mechanical properties desired by the radome application, materials comprising the unit cell must be selected based on their mechanical properties. These materials may include, but are not limited to, Teflon, organic polymers, and composite structures. If the dielectric material selected for the metamaterial radome can sufficiently provide the mechanical properties desired by a radome application (as does the dielectric materials used in prior non-metamaterial radomes), a metamaterial radome consistent with the invention that uses these dielectric materials will exhibit the same mechanical properties. Thus, by dielectric material selection based on desirable mechanical properties and the unit cell described by the invention, the resultant metamaterial radome will provide the electrical and mechanical properties desired for radome applications when used in conjunction with a radiation source. In a typical application the metamaterial 110, FIG. 10 including a number of stacked layers would be employed in combination with an antenna such as a phased array or radiation patch 112 fed through a feed point 114 above an antenna ground plane 116.

Figures 11, 12:
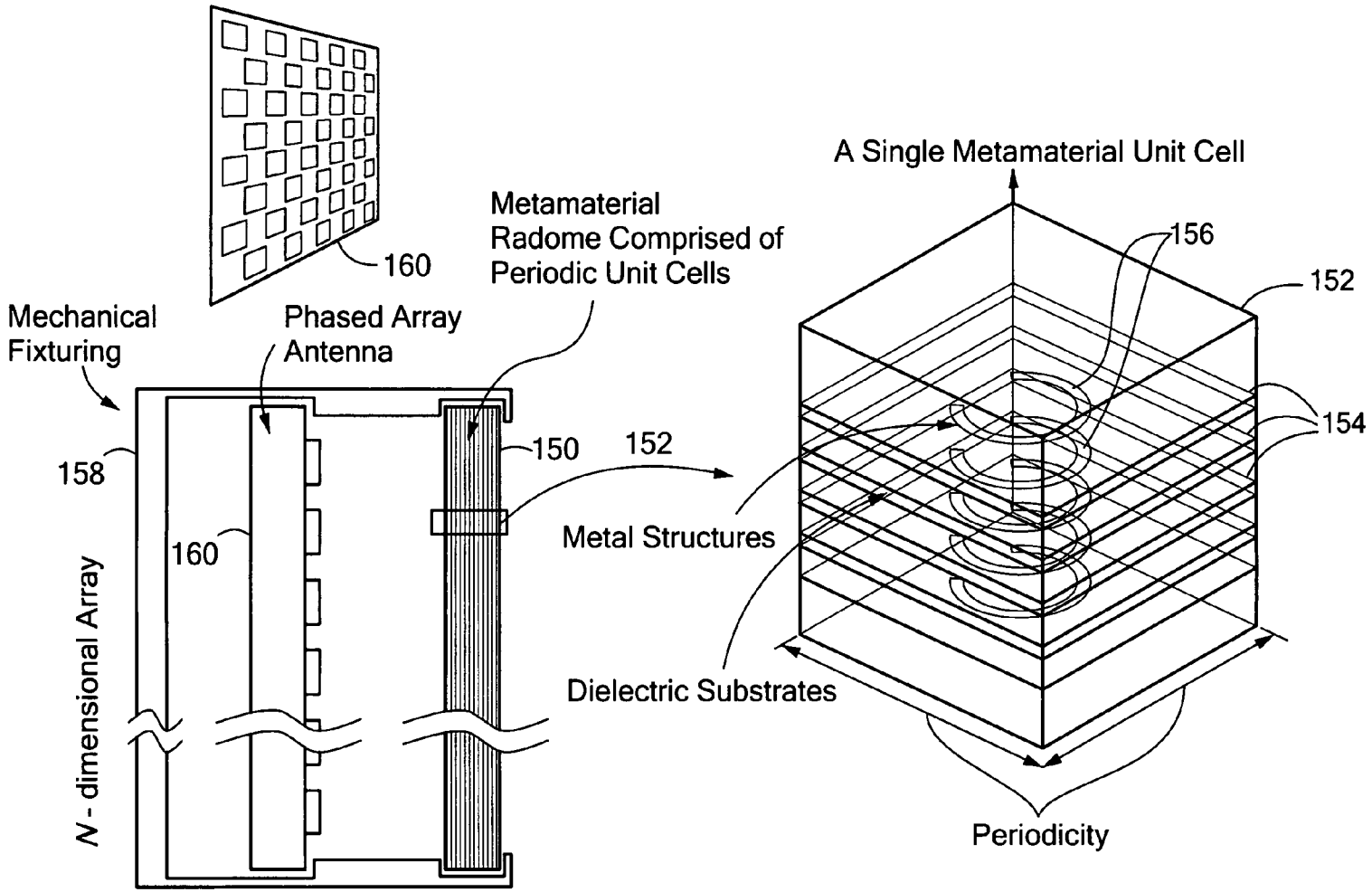
FIG. 11 is a side sectional view of another multi-cell metamaterial radome or isolator associated with a radiation patch antenna.
FIG. 12 is an enlarged, schematic, three dimensional view of a single metamaterial cell.

Another example is shown in FIGS. 11 and 12 where a metamaterial radome 150 is comprised of periodic unit cells 152 each including a plurality of dielectric substrates 154 with metal structures e.g. open turns 156. A typical size of the unit cells is 2 mm×2 mm×0.2 mm with a periodicity of 2 mm in the x and y directions and 0.2 mm in the z direction. Radome 150 is secured in mechanical fixture 158 forming an N-dimensional array with phased array antenna 160 e.g. patch antennas. Fixture 158 holds metamaterial radome 150 parallel to the phased array surface 160 at a constant distance away from the array at all points on the surface. The metamaterial radome is created by replicating the configuration of metal structure, open turn 156 and dielectrics 154 of the unit cell 152 in the two directions perpendicular to the surface of the radome. The unit cell consists of a metal pattern, open turn 156, on dielectric substrate 154, providing a resonant response consistent with FIG. 6.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. A metamaterial radome/isolator system comprising:

a metamaterial medium having a relative permittivity $\in_r$ and relative permeability $\mu_r$, which are low in value and matched to one another; and a radiation source for providing a radiation beam through said metamaterial medium having a frequency beyond the bandgap region where the relative permittivity and the relative permeability of the metamaterial medium are both positive, wherein:

the metamaterial medium comprises a plurality of unit cells arranged in a periodic array in first and second dimensions, each unit cell of the plurality of unit cells comprising:

a plurality of dielectric layers disposed along a third dimension, which is transversely oriented relative to the first and second dimensions; and a plurality of partially, annular open turn metal structures, each partially, annular open turn metal structure being respectively disposed on a corresponding one of the plurality of dielectric layers.

2. The metamaterial radome/isolator of claim 1 in which said metamaterial is made from one of a group including: Rogers Materials, laminates, liquid crystal polymers (LCP's) and Teflon.

3. The metamaterial radome/isolator of claim 1 in which said relative permittivity and relative permeability are in the range of 0.5-10.0.

4. The metamaterial radome/isolator of claim 1 in which said metamaterial has an index of refraction (n) in the range of 0.5-10.

5. The metamaterial radome/isolator of claim 1 in which said radiation source includes a phased array.

6. The metamaterial radome/isolator of claim 1, wherein the partially, annular open turn metal structures have opposite end faces oriented transversely with respect to one another.

7. The metamaterial radome/isolator of claim 6, wherein each of the partially, annular open turn metal structures have substantially similar orientations.

8. A metamaterial radome/isolator for use with a radiation source providing a radiation beam through the radome/isolator having a frequency beyond the bandgap region where the metamaterial permittivity and metamaterial permeability are both positive, the metamaterial radome/isolator comprising:

a metamaterial medium having a relative permittivity and a relative permeability, which are low value and matched to one another, wherein:

the metamaterial medium comprises a plurality of unit cells arranged in a periodic array in first and second dimensions, each unit cell of the plurality of unit cells comprising:

a plurality of dielectric layers disposed along a third dimension, which is transversely oriented relative to the first and second dimensions; and a plurality of partially, annular open turn metal structures, each partially, annular open turn metal structure being respectively disposed on a corresponding one of the plurality of dielectric layers.

9. The metamaterial radome/isolator of claim 8 in which said metamaterial is made from one of a group including: Rogers Materials, laminates, liquid crystal polymers (LCP's) and Teflon.

10. The metamaterial radome/isolator of claim 8 in which said relative permittivity and relative permeability are in the range of 0.5-10.0.

11. The metamaterial radome/isolator of claim 8 in which said metamaterial has an index of refraction (n) in the range of 0.5-10.

12. The metamaterial radome/isolator of claim 8 in which said radiation source includes a phased array.

* * * * *